US010186764B2

(12) United States Patent
Kikuchi et al.

(10) Patent No.: US 10,186,764 B2
(45) Date of Patent: Jan. 22, 2019

(54) ANTENNA DEVICE AND MANUFACTURING METHOD OF ANTENNA DEVICE

(71) Applicant: SUMIDA CORPORATION, Chuo-Ku, Tokyo (JP)

(72) Inventors: Shuichi Kikuchi, Natori (JP); Kei Tanaka, Natori (JP); Takanobu Rokuka, Natori (JP); Shigeru Mahara, Natori (JP); Noriaki Iwasaki, Natori (JP); Yoshinori Miura, Natori (JP); Hiroshi Kawasaki, Natori (JP)

(73) Assignee: SUMIDA CORPORATION, Tokyo (JP)

( * ) Notice: Subject to any disclaimer, the term of this patent is extended or adjusted under 35 U.S.C. 154(b) by 67 days.

(21) Appl. No.: 15/363,419

(22) Filed: Nov. 29, 2016

(65) Prior Publication Data

US 2017/0155188 A1 Jun. 1, 2017

(30) Foreign Application Priority Data

Nov. 30, 2015 (JP) ..... 2015-233876

(51) Int. Cl.
*H01Q 1/32* (2006.01)
*H01Q 7/08* (2006.01)
(Continued)

(52) U.S. Cl.
CPC ..... *H01Q 1/3283* (2013.01); *H01Q 1/3241* (2013.01); *H01Q 7/00* (2013.01); *H01Q 7/08* (2013.01); *H01Q 23/00* (2013.01)

(58) Field of Classification Search
CPC ..... H01Q 1/3241
See application file for complete search history.

(56) References Cited

U.S. PATENT DOCUMENTS 7,081,864 B2 7/2006 Okamura et al.
7,427,963 B2 9/2008 Moriya
(Continued)

FOREIGN PATENT DOCUMENTS

JP 05075011 A1 3/1993
JP 05167296 A1 7/1993
JP 2013225947 A1 10/2013

OTHER PUBLICATIONS

Extended European Search Report corresponding to Application No. 16200419.8-1927; dated May 3, 2017.

*Primary Examiner* — Graham Smith
(74) *Attorney, Agent, or Firm* — Cantor Colburn LLP

(57) ABSTRACT

An antenna device including: a core formed by a magnetic material; a terminal attachment unit which is arranged on one end side of the core and concurrently, which is provided with an opening portion of penetration-state; a coil which is arranged on the outer-peripheral side of the core and concurrently, which is formed by winding a conductive wire; and at least a pair of terminal members which are attached to the terminal attachment unit and concurrently, which are provided with a chip-support-piece portion positioned at the opening portion and concurrently electrically connected to an electronic component while being equipped with aforesaid electronic component having a chip-shape, wherein for the chip-support-piece portion, there is provided a positioner which carries out the positioning of the electronic component.

5 Claims, 14 Drawing Sheets

(51) Int. Cl.
*H01Q 23/00* (2006.01)
*H01Q 7/00* (2006.01)

(56) References Cited

U.S. PATENT DOCUMENTS

| | | | | |
|---|---|---|---|---|
| 9,407,009 | B2 | 8/2016 | Mahara | |
| 2008/0030423 | A1 | 2/2008 | Shigemoto | |
| 2010/0164822 | A1 | 7/2010 | Iwasaki et al. | |
| 2012/0176215 | A1* | 7/2012 | Kudo ..... | H01F 27/34 336/221 |
| 2014/0157593 | A1 | 6/2014 | Lin et al. | |
| 2015/0042529 | A1 | 2/2015 | Tanaka et al. | |
| 2015/0295315 | A1 | 10/2015 | Tanaka et al. | |

* cited by examiner

ANTENNA DEVICE AND MANUFACTURING METHOD OF ANTENNA DEVICE

CROSS REFERENCES TO RELATED APPLICATIONS

The present invention contains subject matter related to Japanese Patent Application JP2015-233876 filed in the Japanese Patent Office on Nov. 30, 2015, the entire contents of which being incorporated herein by reference.

BACKGROUND OF THE INVENTION

Field of the Invention

The present invention relates to an antenna device and a manufacturing method of the antenna device.

Description of the Related Art

In recent years, the number of vehicles has been increasing in which there are mounted antenna devices for receiving signals for carrying out locking and unlocking of the doors thereof. For such antenna devices, there is, for example, an antenna disclosed in a Patent Document 1 (Japanese unexamined patent publication No. 2013-225947). For the antenna device disclosed in the Patent Document 1, a hollow portion is provided at a base and a pair of metal terminals are arranged at that hollow portion. Then, by employing a configuration of striding over the pair of metal terminals, a chip capacitor is attached to those metal terminals. With regard to this attachment, cream solder is to be melt, for example, by using a spot-reflow method in which a hot air is sprayed or the like and in this manner, the chip capacitor is to be soldered onto the metal terminals.

SUMMARY OF THE INVENTION

Meanwhile, according to the configuration disclosed in the patent document 1, the cream solder becomes in a liquid state on an occasion of the soldering and therefore, there is sometimes a case where the chip capacitor will float in that solder of a liquid state. Then, there is a fear that the chip capacitor will be positionally-deviated on the metal terminal. This positional-deviation of the chip capacitor easily tends to lead to a failure of soldering and therefore, when mounting a chip capacitor, it is desirable not to cause a positional-deviation.

The present invention was invented in view of this problem and addresses to try to provide an antenna device and a manufacturing method of an antenna device in which when soldering an electronic component, it is possible to prevent the electronic component from causing a positional-deviation.

One aspect of an antenna device of the present invention has a feature in which there are included: a core formed by a magnetic material; a terminal attachment unit which is arranged on one end side of the core and concurrently, which is provided with an opening portion of penetration-state; a coil which is arranged on the outer-peripheral side of the core and concurrently, which is formed by winding a conductive wire; and at least a pair of terminal members which are attached to the terminal attachment unit and concurrently, which are provided with a chip-support-piece portion positioned at the opening portion and concurrently electrically connected to an electronic component while being equipped with aforesaid electronic component having a chip-shape, wherein for the chip-support-piece portion, there is provided a positioner which carries out the positioning of the electronic component.

Also, in addition to the above-mentioned invention, it is preferable for another aspect of an antenna device of the present invention to further employ a configuration in which the positioner is a protruding portion which is formed by protruding a portion of the chip-support-piece portion toward the equipped-side of the electronic component compared with other portions thereof.

Further, in addition to the above-mentioned invention, it is preferable for another aspect of an antenna device of the present invention to further employ a configuration in which the positioner is a positioning concave-portion which is formed by recessing a portion of the chip-support-piece portion toward the opposite side with respect to the equipped-side of the electronic component.

Also, in addition to the above-mentioned invention, it is preferable for another aspect of an antenna device of the present invention to further employ a configuration in which the positioner is a bent portion which is formed by bending the edge portion side of the chip-support-piece portion so as to be directed toward the equipped-side of the electronic component.

Further, in addition to the above-mentioned invention, it is preferable for another aspect of an antenna device of the present invention to further employ a configuration in which the positioner is provided with a curved portion which forms a clearance gap with respect to the electronic component and concurrently, which stores solders on an occasion of the mounting thereof.

In addition, one aspect of a manufacturing method of an antenna device of the present invention has a feature for an antenna device including a core formed by a magnetic material, a terminal attachment unit which is arranged on one end side of the aforesaid core and concurrently, which has an opening portion of penetration-state, at least a pair of terminal members which are attached to the terminal attachment unit, which are provided with a chip-support-piece portion for mounting an electronic component and concurrently, in which the aforesaid chip-support-piece portion is arranged at the opening portion, and a coil which is arranged on the outer-peripheral side of the core and concurrently, which is formed by winding a conductive wire, in which there are included the steps of: forming a positioner which carries out the positioning of the electronic component with respect to the chip-support-piece portion; forming the terminal member and the terminal attachment unit integrally by insert-molding before or after the step of forming a positioner; and soldering and mounting the aforesaid electronic component in a state of striding over the pair of chip-support-piece portions and in a state of positioning the electronic component by the positioner after the step of forming a positioner and the step of forming the terminal member and the terminal attachment unit integrally.

According to the present invention, when soldering an electronic component, it becomes possible to prevent the electronic component from causing a positional-deviation.

DESCRIPTION OF THE PREFERRED EMBODIMENTS

First Exemplified Embodiment

Hereinafter, there will be explained an antenna device 10A relating to a first exemplified embodiment of the present invention with reference to the drawings. It should be noted in the explanation hereinafter that there sometimes happens a case in which the explanation is carried out by using the XYZ rectangular coordinate system. Within the explanation thereof, the X-direction is assumed to be a longitudinal direction of the antenna device 10A, in which the X1 side is assumed to be the side at which a connector connecting unit 45 mentioned later is positioned and the X2 side is assumed to be the side opposite thereto. In addition, the Z-direction is assumed to be a thickness direction of the antenna device 10A, in which the Z1 side is assumed to be the upper side in FIG. 3 and the Z2 side is assumed to be the lower side in FIG. 3. In addition, the Y-direction is assumed to be the direction orthogonal to the XZ-directions (i.e. width direction), in which the Y1 side is assumed to be the right front side in FIG. 1 and the Y2 side is assumed to be the rear left side which is the side opposite thereto.

<With Regard to Whole Constitution of Antenna Device 10A>

Figure 1:
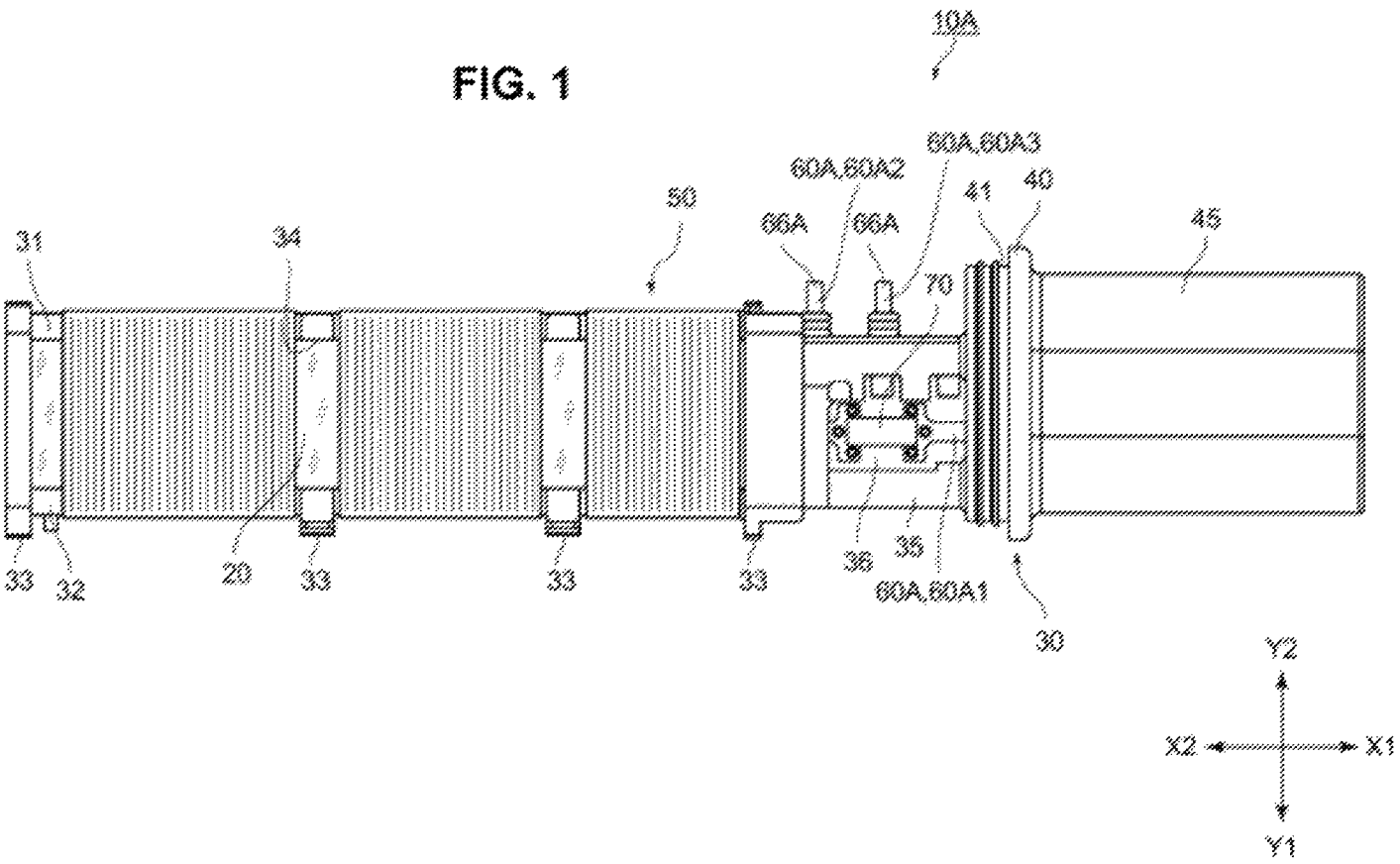
FIG. 1 is a plan view showing a constitution of an antenna device relating to a first exemplified embodiment of the present invention.

FIG. 1 is a plan view showing a constitution of the antenna device 10A. The antenna device 10A shown in FIG. 1 includes a core 20, a base 30, a coil 50, a connection terminal 60A and a capacitor 70 as the main constituents thereof.

The core 20A is formed by a magnetic material and concurrently, is provided in an elongated shape (bar shape) toward the X-direction. It should be noted for the core 20A that the material thereof is made to be a magnetic material, in which for the magnetic material, it is possible to use a variety of magnetic materials such as, for example, various kinds of ferrites such as nickel based ferrites or manganese based ferrites, permalloy, sendust and the like, and to use a variety of mixtures of magnetic materials.

In addition, as shown in FIG. 1, on the outer circumferential side of the core 20, there is mounted the base 30. In other words, the core 20 is inserted into a core insertion portion 34 of the base 30. It is preferable for the material of the base 30 to employ a thermoplastic resin or thermosetting resin which has excellent insulation properties. It should be noted that for one example of the material which constitutes the base 30, there can be cited PBT (polybutyleneterephthalate), but it is allowed to employ another resin for the material thereof. In addition, in view of the fact that there exists a case in which the base 30 may receive a heat damage caused by a soldering, a welding process and the like, it is more preferable to use a heat-resistant resin.

Here, as shown in FIG. 1, the base 30 is provided with a bobbin unit 31, a terminal attachment unit 35, a flange unit 40 and a connector connecting unit 45. The bobbin unit 31 is provided with a winding-frame unit 32 and a positioning convex portion 33. It is allowed for the winding-frame unit 32A to employ a cylindrical shape, but it is allowed to employ a lightened shape in which the center body is eliminated appropriately. In addition, the positioning convex portions 33 are provided on the both end sides of the winding-frame unit 32 and are the portions which protrude from the winding-frame unit 32. The positioning convex portion 33 is formed to be a portion which positions the coil 50 and concurrently, prevents the winding irregularity thereof by separating that coil appropriately.

In addition, on one side (X1 side) of the base 30A, there is provided the terminal attachment unit 35 in a state of being continuous therewith. At the terminal attachment unit 35, the terminal member 60A which will be mentioned later is arranged and concurrently, the unit 35 is a unit in which the capacitor 70 is mounted on this terminal member 60A. Therefore, this terminal attachment unit 35A is formed in a state in which there exists no core 20A in the inside thereof. However, in case of inserting the core 20 and forming coil 50 after mounting the capacitor 70 beforehand, it is also possible for the core 20 to be inserted through this terminal attachment unit 35.

Figure 2:
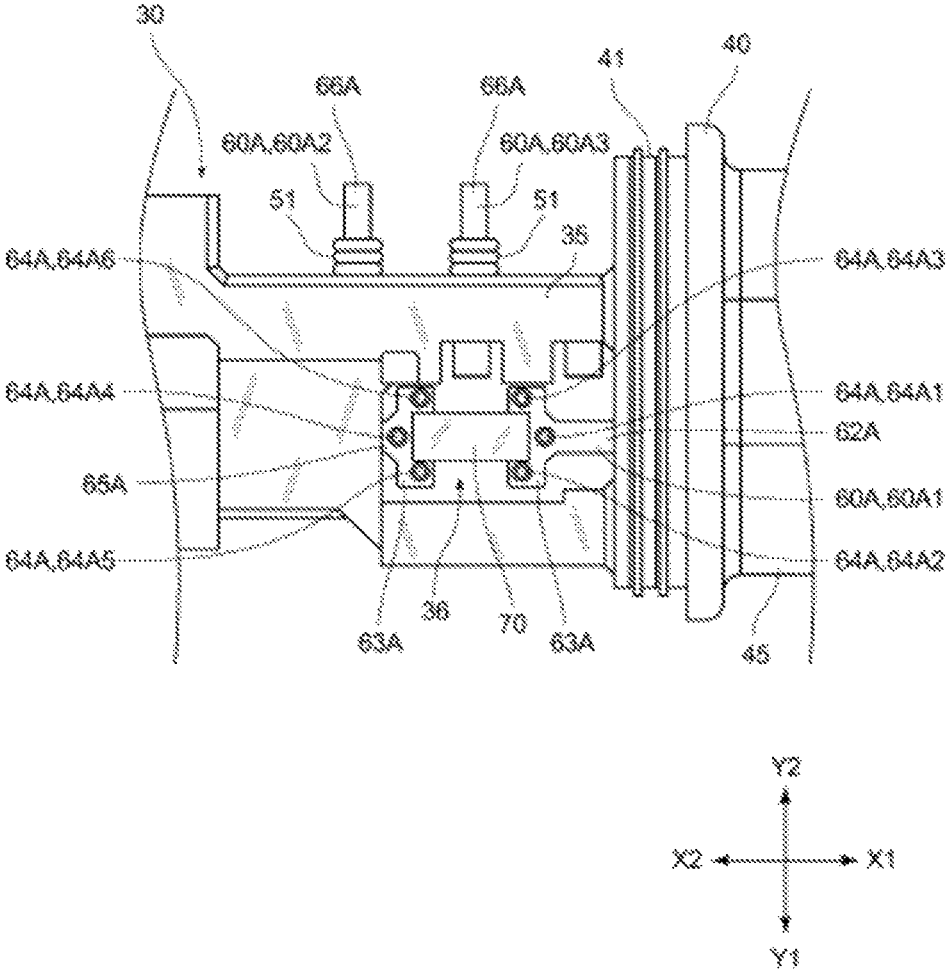
FIG. 2 is a plan view showing a vicinity of a terminal attachment unit by being enlarged within the antenna device which is shown in FIG. 1.
Figure 3:
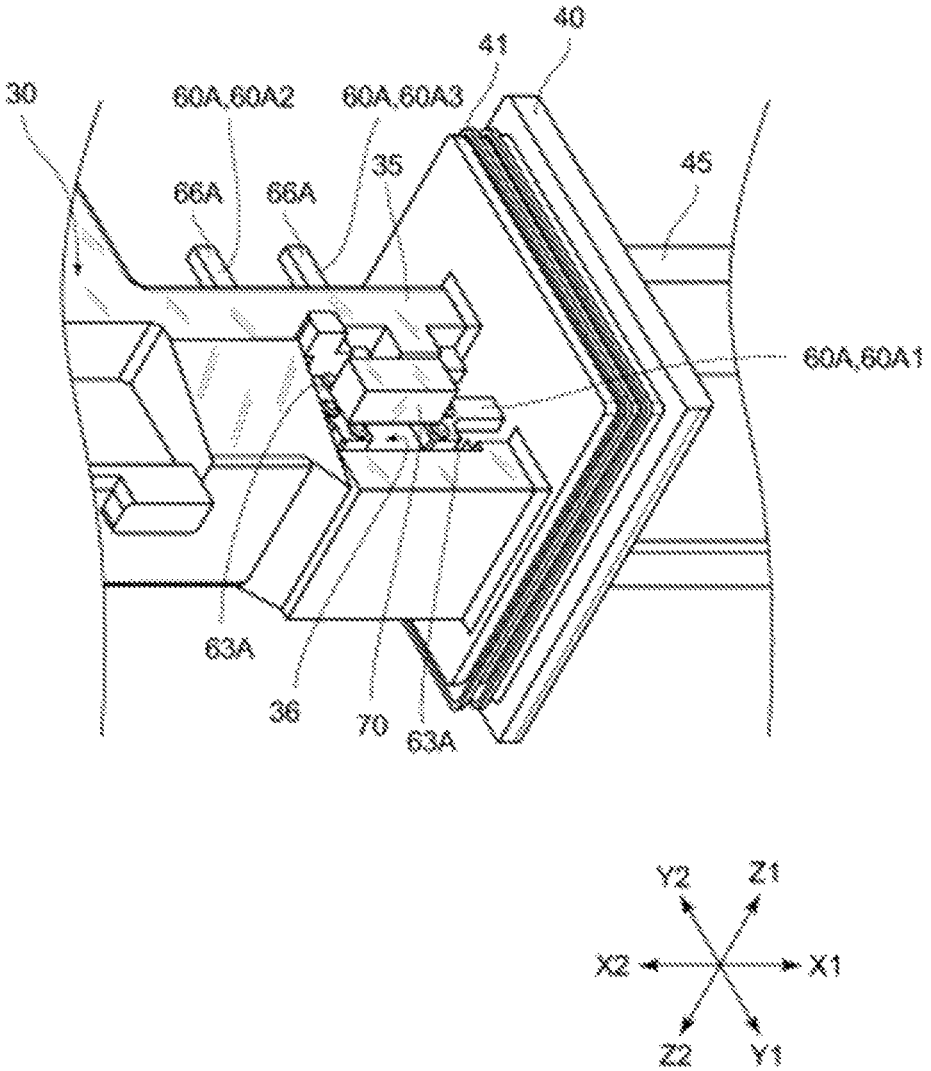
FIG. 3 is a perspective view of a vicinity of the terminal attachment unit by being enlarged in the antenna device which is shown in FIG. 1.

FIG. 2 is a plan view showing a vicinity of a terminal attachment unit 35 by being enlarged within the antenna device 10A. FIG. 3 is a perspective view of a vicinity of the terminal attachment unit 35 by being enlarged in the antenna device 10A. As shown in FIGS. 2 and 3, the terminal attachment unit 35 is provided with an opening portion 36 which penetrates in the up and down direction (Z direction). As shown in FIG. 2, the area of this opening portion 36 is provided to be adequately large compared with the area of the capacitor 70 when viewed planarly. Furthermore, the size of this area is provided to have a cross-sectional size into which a jig or a blade unit of a cutting apparatus can enter when cutting out the terminal member 60A from a plate terminal which exists at the opening portion 36 as mentioned later. It should be noted in this exemplified embodiment that the opening portion 36 is provided in a rectangular shape which is long in the longitudinal direction (X direction) of the antenna device 10A.

It should be noted that the arrangement of the terminal member 60A at the opening portion 36 will be mentioned later.

In addition, at the boundary portion on one side (X1 side) in the longitudinal direction (X direction) of the terminal attachment unit 35, there is provided the flange unit 40. According to the constitution shown in FIGS. 1 to 3, the flange unit 40 is formed as a unit which is provided in a plate shape having a predetermined thickness. This flange unit 40 is a unit for fitting a protective case which is not shown and for the fitting thereof, there is included a step portion which is recessed by one step in which the outer circumferential side thereof is directed from the other end side (X2 side) toward the one end side (X1 side).

In addition, for the flange unit 40, there is provided a terminal hole which is not shown. Into this terminal hole, there will be plugged-in one side (X1 side) of the terminal member 60A1, 60A3. The terminal hole is provided so as to go along the longitudinal direction (X direction) and therefore, the terminal members 60A1, 60A3, which are pushed into the terminal hole from the other side (X2 side), protrude toward a connector hole (not shown) which exist at the connector connecting unit 45. It should be noted in this exemplified embodiment that the terminal hole is provided as a pair of holes in order to plugging-in the terminal member 60A1 and the terminal member 60A3. However, it is possible to change the number of the terminal holes appropriately corresponding to the required number of the terminal members 60 or the like.

In addition, there is provided the connector connecting unit 45 on one side (X1 side) at a farer position than that of the flange unit 40 in the longitudinal direction (X direction). The connector connecting unit 45 includes a connector hole which is not shown and there is employed a configuration in which the other end side (X2 side) of that connector hole is formed to be bottomed caused by the existence of the above-mentioned flange unit 40. In addition, the distal sides of the terminal members 60A1, 60A3 protrude respectively in the inside of the connector hole. Then, there is employed such a configuration that when plugging-in an external connector into the connector hole, the external connector and the terminal members 60A1, 60A3 are connected electrically in which it is possible to conduct an electric current through a coil 50 or a capacitor 70 which will be mentioned later.

In addition, as shown in FIG. 1, the coil 50 is formed by winding a conductive wire 51 (see FIG. 2 and the like). In this exemplified embodiment, one terminal and the other terminal of the conductive wire 51 which forms the coil 50 are respectively bound around the binding terminal portions 66A of the terminal member 60A1 and the terminal member 60A2, and thereafter, are respectively fixed by soldering or the like. It should be noted that the coil 50 and the capacitor 70 constitute an LC resonant circuit by an electrical connection including the terminal members 60A.

Next, there will be explained the terminal member 60A. As shown in FIGS. 2 and 3, the terminal members 60A are arranged around the periphery of the opening portion 36. The terminal members 60A are formed by punching-out a metal-made plate terminal 90 (see FIG. 4) and by cutting-off the plate terminal to form separate parts. It should be noted that the plate terminal 90 is a terminal in a stage of being provided continuously before cutting-off the separated terminal members 60A and is formed by pressing the metal-made plate-shaped portion to have a desired shape or the like.

Here, in this exemplified embodiment, the terminal members 60A are provided as three members. Specifically, there are provided terminal members 60A1 to 60A3. The terminal member 60A1 is a terminal member 60A which is positioned on the front side (Y1 side) in the width direction (Y-direction) and also on one side (X1 side) in the longitudinal direction (X-direction). For this terminal member 60A1, one side (X1 side) thereof in the longitudinal direction (X-direction) protrudes in the connector hole of the connector connecting unit 45. Therefore, the terminal member 60A1 is connected electrically with the external connector.

When describing this terminal member 60A1 in detail, the terminal member 60A1 is provided with a connection terminal portion 62A, a chip-support-piece portion 63A and protruding portions 64A. The connection terminal portion 62A is a portion which is continuous to the chip-support-piece portion 63A. One side (X1 side) of this connection terminal portion 62A is inserted through the terminal hole of the above-mentioned flange unit 40 and protrudes in the connector hole of the connector connecting unit 45. In addition, the chip-support-piece portion 63A is provided to have a wider width compared with the connection terminal portion 62A (that is, the size thereof in the Y-direction is provided to be longer) and is a portion on which the capacitor 70 is supportable.

In addition, the protruding portion 64A is a portion which protrudes from the upper surface (surface on the Z1 side) of the chip-support-piece portion 63A. This protruding portion 64A corresponds to one example of the positioner. For the constitution shown in FIGS. 2 and 3, the protruding portions 64A are provided as three portions and depending on those portions, there will be attained the positioning on the terminal member 60A1 side within the capacitor 70. Specifically, among the protruding portions 64A, there is a protruding portion which exists at a position on one side (X1 side) in the longitudinal direction (X-direction) and depending on that portion, there is prevented a phenomenon in which the capacitor 70 will be positionally-deviated toward one side (X1 side) of the longitudinal direction (X-direction). Hereinafter, this protrusion 64A will be referred to as a protrusion 64A1.

In addition, with regard to the protruding portions 64A, there exist two protruding portions which are provided on the other side (X2 side) with respect to the protrusion 64A1 in the longitudinal direction (X-direction). Specifically, with regard to the protruding portions 64A, there exists a protruding portion which is provided on the front side (Y1 side) in the width direction (Y-direction) and likewise a protruding portion which is provided on the rear side (Y2 side) in the width direction (Y-direction). Then, depending on these two protruding portions 64A, there is prevented a phenomenon in which the capacitor 70 will be positionally-deviated toward the width direction (Y-direction). Hereinafter, the protrusion 64A which exists on the front side (Y1 side) in the width direction (Y-direction) will be referred to as a protrusion 64A2 and the protrusion 64A which exists on the rear side (Y2 side) in the width direction (Y-direction) will be referred to as a protrusion 64A3.

In this manner, with regard to the protrusions 64A, there exists the protrusion 64A1 which restricts the movement of the capacitor 70 toward one side (X1 side) in the longitudinal direction (X-direction) and there exist the protrusions 64A2, 64A3 which restrict the movement of the capacitor 70 toward the front side (Y1 side) and the rear side (Y2 side) respectively in the width direction (Y-direction). It should be noted that it is allowed for those protrusions 64A1 to 64A3 to abut against the end surface or the side surface of the capacitor 70, but it is also allowed for those protrusions not to abut against them.

Next, there will be explained the terminal member 60A2. The terminal member 60A2 is provided with a chip-support-piece portion 63A, protruding portions 64A, a coupling portion 65A and a binding terminal portion 66A. Within those elements, the chip-support-piece portion 63A is formed in a state of being line-symmetrical with respect to the chip-support-piece portion 63A in the above-mentioned terminal member 60A1 by sandwiching the symmetrical line along the width direction (Y-direction). Therefore, the detail explanation thereof will be omitted. It should be noted that it is allowed even if the chip-support-piece portion 63A in the terminal member 60A2 does not have a symmetrical shape with respect to the chip-support-piece portion 63A in the terminal member 60A1.

In addition, also the protruding portions 64A in the terminal member 60A2 are formed in a state of being line-symmetrical with respect to the protruding portions 64A in the above-mentioned terminal member 60A1 by sandwiching the symmetrical line along the width direction (Y-direction). Specifically, with regard to the protrusions 64A in the terminal member 60A2, there exists a protrusion 64A4 which restricts the movement of the capacitor 70 toward the other side (X2 side) in the longitudinal direction (X-direction) and there exist the protrusions 64A5, 64A6 which restrict the movement of the capacitor 70 toward the front side (Y1 side) and the rear side (Y2 side) respectively in the width direction (Y-direction). It is allowed also for those protrusions 64A4 to 64A6 to abut against the end surface or the side surface of the capacitor 70, but it is also allowed for those protrusions not to abut against them.

Depending on the existence of the six protrusions 64A1 to 64A6 as mentioned above, the whole configuration thereof is formed such that the phenomenon in which the capacitor 70 tends to positionally-deviate within the XY plain can be repressed excellently.

In addition, the chip-support-piece portion 63A of the terminal member 60A2 is connected with a coupling portion 65A. The coupling portion 65A is a portion for interlinking the chip-support-piece portion 63A and the binding terminal portion 66A in which the major part thereof is covered by the resin portion of the terminal attachment unit 35. It should be noted that the coupling portion 65A is provided in a substantially L-shape, but it is allowed to employ another shape such as a linear shape or the like.

In addition, the binding terminal portion 66A is provided so as to be continuous to the coupling portion 65A. The binding terminal portion 66A is a portion around which one terminal of the conductive wire 51 which forms the coil 50 will be bound. For that reason, the binding terminal portion 66A is provided so as to protrude toward the outside from the side surface of the terminal attachment unit 35. Around this binding terminal portion 66A, one terminal of the conductive wire 51 which forms the coil 50 is bound and thereafter, soldering or the like is applied thereto, and depending on this process, the terminal member 60A2 and the coil 50 become an electrically-conductive state.

Next, the terminal member 60A3 will be explained. The terminal member 60A3 is provided with a connection terminal portion 62A (see FIG. 4) and a binding terminal portion 66A. The connection terminal portion 62A is a portion similar to the connection terminal portion 62A in the above-mentioned terminal member 60A1, and one side (X1 side) of the aforesaid connection terminal portion 62A is inserted through the terminal hole of the flange unit 40 and protrudes in the connector hole of the connector connecting unit 45. It should be noted that the portion within the connection terminal portion 62A, which does not protrude from the connector hole of the connector connecting unit 45 is buried in the resin portion of the terminal attachment unit 35.

In addition, the binding terminal portion 66A is a portion similar to the above-mentioned binding terminal portion 66A in the terminal member 60A2 and protrudes toward the outside from the side surface of the terminal attachment unit 35. It should be noted that around this binding terminal portion 66A, the other terminal of the conductive wire 51 which forms the coil 50 will be bound. Then, after the binding thereof, soldering or the like is applied thereto and depending on this process, the terminal member 60A3 and the coil 50 become an electrically-conductive state.

In addition, in this exemplified embodiment, the chip capacitor 70 is a chip capacitor of an SMD (Surface Mount Device) type, but it is allowed to employ another type of capacitor. It should be noted that the capacitor 70 corresponds to one example of the electronic component. This capacitor 70 is installed at the pair of chip-support-piece portions 63A on the lower surface side (Z2 side) thereof and is fixed by a soldering or the like in a state of being electrically conductive. At that time, for the reason that six protrusions 64A exist around the periphery of the capacitor 70, the capacitor 70 is prevented from being positionally-deviated.

<With Regard to Manufacturing Method of Antenna Device 10A>

Figure 4:
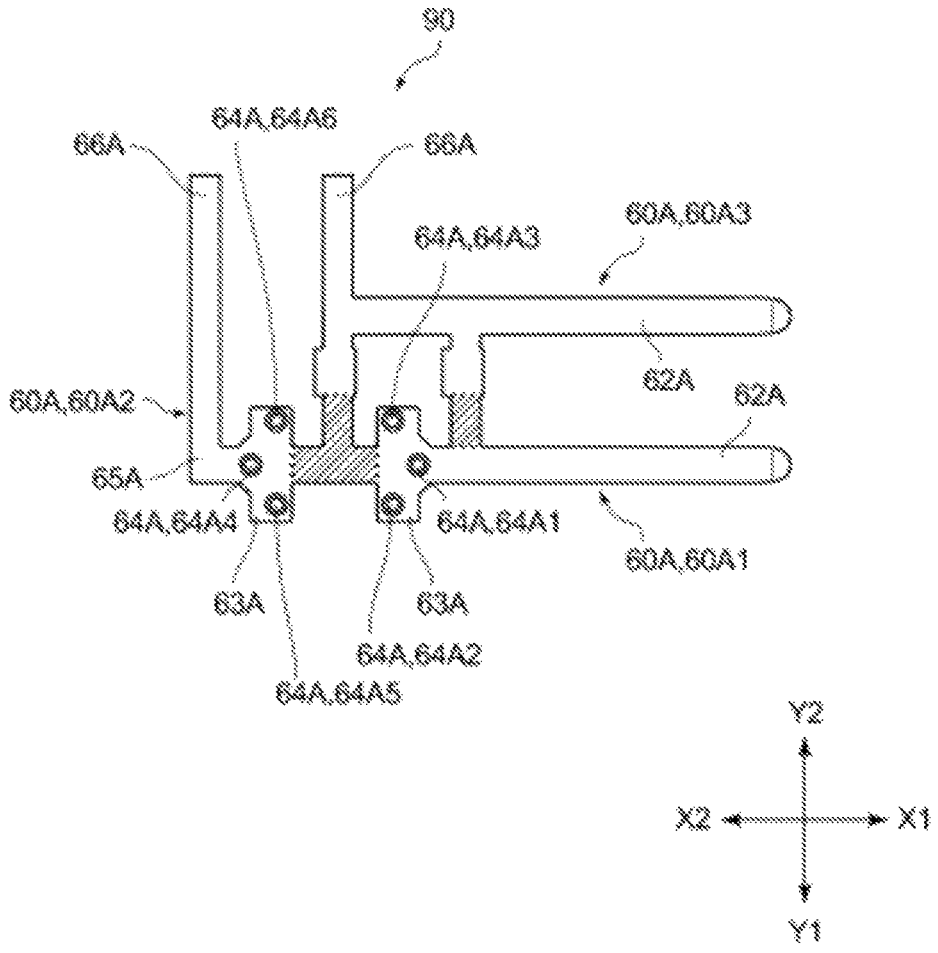
FIG. 4 is a plan view showing one example a plate terminal relating to the first exemplified embodiment of the present invention.

In case of manufacturing the antenna device 10A having a constitution as described above, prior to the injection-molding of the base 30, a plate terminal 90 is formed from a metal plate, for example, by a press-processing using a press machine or the like. FIG. 4 is a plan view showing one example of the plate terminal 90. This plate terminal 90 shows a terminal before cutting-out the terminal members 60A1 to 60A3 and is, so to speak, in a state in which the terminal members 60A1 to 60A3 are tied all together. However, in FIG. 4, hatching is applied for the cut-out portions and the portions without the hatching are used for the terminal members 60A (terminal members 60A1 to 60A3). It should be noted in the press-processing that also the boss-like protrusions 64A are formed at the same time (this process corresponds to "positioner forming process").

Figure 5:
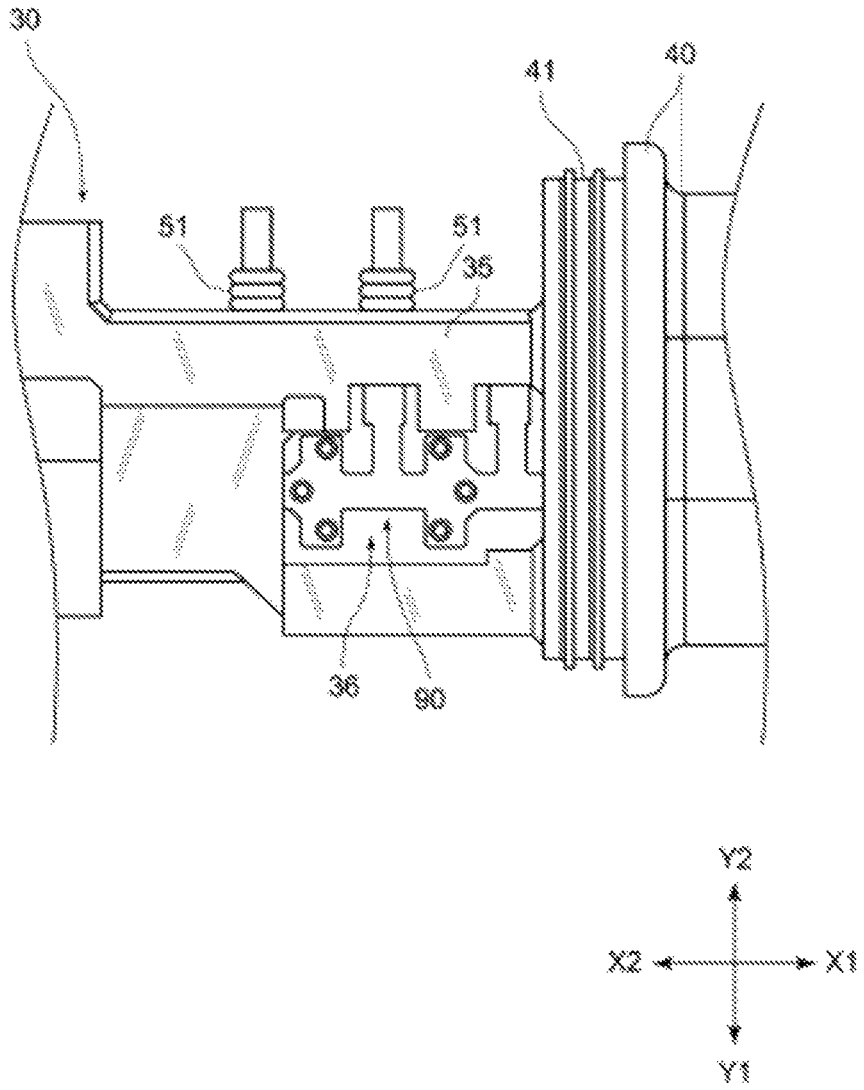
FIG. 5 relates to the first exemplified embodiment of the present invention and is a plan view showing a state in which a base is formed by injection-molding and concurrently, showing a state before cutting the plate terminal.

In addition, after the plate terminal 90 is formed by the press-processing, the base 30 is formed by injection-molding (this process corresponds to "forming process"). On an occasion of the injection-molding of this base 30, there is carried out an insert-molding in which the above-mentioned plate terminal 90 is disposed in the inside of the mold. By carrying out an injection-molding in a state of disposing the plate terminal 90 in the inside of the mold, the resin-made base 30 will be formed in a state of being integral with the plate terminal 90. FIG. 5 is a plan view showing a state in which a base 30 is formed by injection-molding and concurrently, showing a state before cutting the plate terminal 90.

After this injection-molding, predetermined portions of the plate terminal 90 are punched out by using a press machine or the like. At that time, while holding the vicinity of the portion to be cut by a jig or the like, the blade unit of the cutting apparatus is inserted into the opening portion 36 while being depressed. Then, the terminal members 60A1 to 60A3 are formed in a state of being separated respectively.

In addition, depending on the fact that the plate terminal 90 is cut, the terminal members 60A1 to 60A3 are formed and thereafter, the capacitor 70 is mounted (this process corresponds to the attachment process). At that time, the cream solder is coated on the chip-support-piece portion 63A of the terminal member 60A1 and on the chip-support-piece portion 63A of the terminal member 60A2, and thereafter, the capacitor 70 is mounted such that the capacitor 70 bridges over the pair of chip-support-piece portions 63A. Thereafter, it is possible to utilize such a method of heating that coated portions. However, it is allowed to mount the capacitor 70, for example, by a method of laser welding, etc.

In addition, before or after the mounting of the capacitor 70, the core 20 is mounted on the core insertion portion 34 of the base 30 and after that mounting, the coil 50 is formed by winding the conductive wire 51 around the winding-frame unit 32. Then, after the formation of the coil 50, one terminal of the conductive wire 51 is bound onto the binding terminal portion 66A of the terminal member 60A2. In addition, the other terminal of the conductive wire 51 is bound onto the binding terminal portion 66A of the terminal member 60A3. After those bindings, the binding portions mentioned above are fixed, for example, by a soldering depending on a dip method or the like.

In addition, as mentioned above, that the case (not shown) is fitted with and bonded onto the step portion 41. In this manner, the antenna device 10A is formed.

Modified Example of First Exemplified Embodiment

Figure 6:
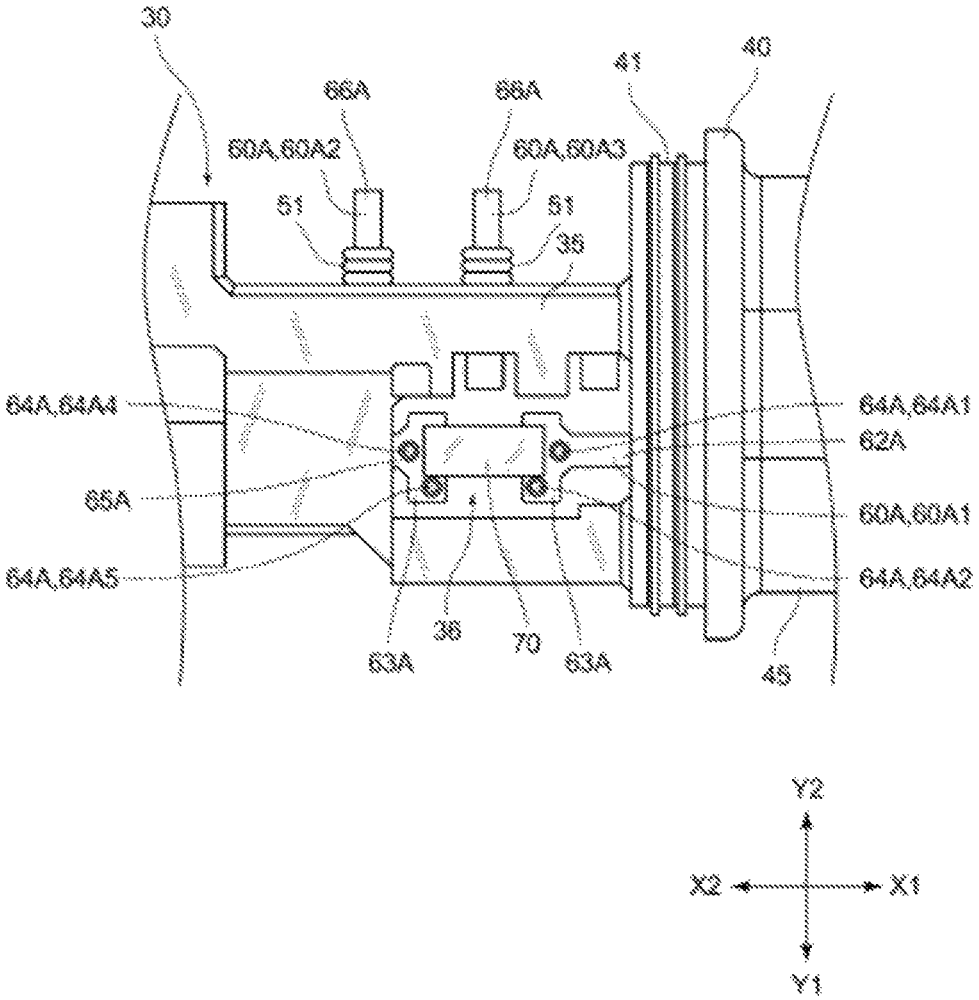
FIG. 6 relates to a modified example of the first exemplified embodiment of the present invention and is a plan view showing a vicinity of the terminal attachment unit by being enlarged in the antenna device.
Figure 7:
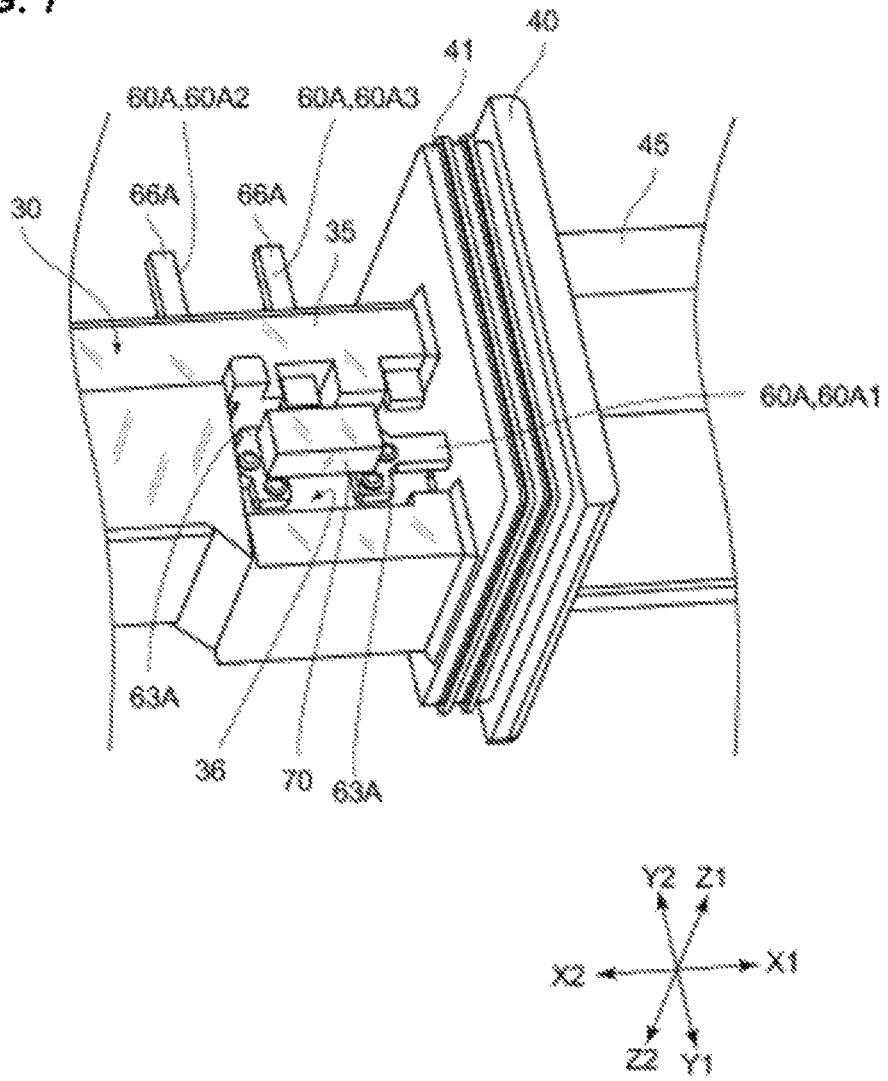
FIG. 7 relates to a modified example of the first exemplified embodiment of the present invention and is a perspective view showing a vicinity of the terminal attachment unit by being enlarged in the antenna device.

It should be noted that for each of the chip-support-piece portions 63A shown in FIGS. 1 to 4, three of protrusions 64A are provided therein. However, as shown in FIGS. 6 and 7, it is allowed to employ a configuration in which two of protrusions 64A are provided for each of the chip-support-piece portions 63A. FIG. 6 relates to a modified example of the first exemplified embodiment and is a plan view showing a vicinity of the terminal attachment unit 35 by being enlarged within the antenna device 10A. FIG. 7 relates to a modified example of the first exemplified embodiment and is a perspective view showing a vicinity of the terminal attachment unit 35 by being enlarged in the antenna device 10A.

In the constitution shown in the above-mentioned FIGS. 2 and 3, the protrusion 64A3 exists also on the rear side (Y2 side) of the width direction (Y-direction) of the chip-support-piece portion 63A. However, in the constitution shown in FIGS. 6 and 7, the protrusion 64A3 does not exist on the rear side (Y2 side) of the width direction (Y-direction) of the chip-support-piece portion 63A. It should be noted in the constitution shown in FIGS. 6 and 7 that for the chip-support-piece portion 63A of the terminal member 60A1, there exist the protrusions 64A1, 64A2 and for the chip-support-piece portion 63A of the terminal member 60A2, there exist the protrusions 64A4, 64A5. Therefore, for each of the chip-support-piece portions 63A, there exist two of protrusions 64A.

In a case in which two protrusion 64A exist for each of the chip-support-piece portions 63A in this manner, it is possible to make correspondence flexibly with the size change (in particular, change toward the width direction "Y-direction") of the capacitor 70 when compared with a case in which three protrusions exist. In addition, in case of providing three protrusions 64A for each of the chip-support-piece portions 63A, it becomes necessary for the width size of the chip-support-piece portion 63A to provide a size which corresponds to the number of the protrusions 64A. However, in the constitution shown in FIGS. 5 and 6, it is enough only if two protrusions 64A are provided for each of the chip-support-piece portions 63A and therefore, even if there is a limitation for the width of the chip-support-piece portion 63A, it is possible to mount a capacitor 70 having a comparatively large size.

Figure 8:
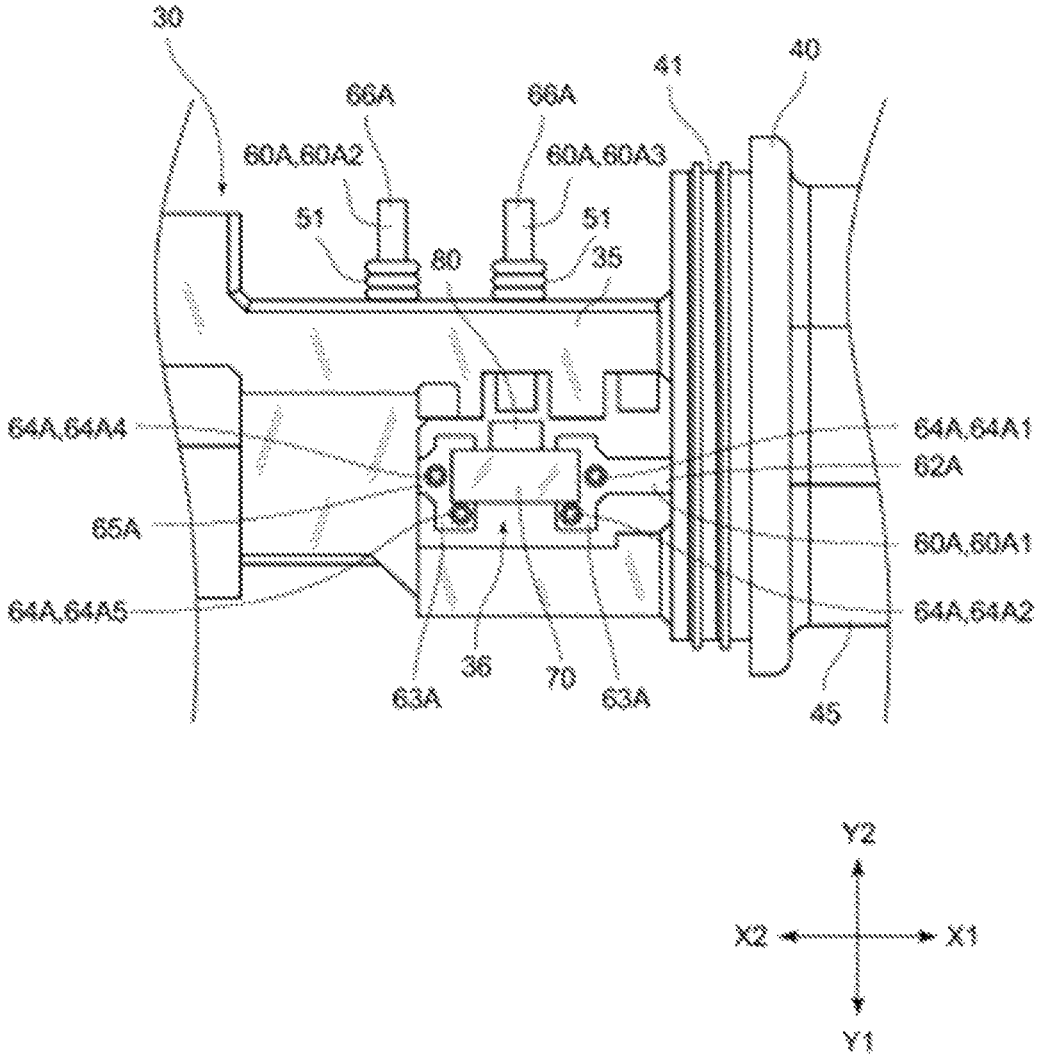
FIG. 8 relates to the first exemplified embodiment of the present invention and is a plan view showing a configuration of mounting a capacitor by using a holding jig.

Here, also in case of manufacturing the antenna device 10A including the chip-support-piece portions 63A as shown in FIGS. 6 and 7, it is possible to manufacture this antenna device similarly as the antenna device 10A shown in FIGS. 1 to 4. More specifically, the plate terminal 90 is cut and the cream solder is coated onto each of the chip-support-piece portions 63A. It should be noted that in case of mounting the capacitor 70 after coating the cream solder, it is preferable to use a holding jig 80 such as shown in FIG. 8. FIG. 8 is a plan view showing a configuration of mounting the capacitor 70 by using a holding jig 80. At that time, into the opening portion 36, the holding jig 80 is inserted on the opposite side (Y2 side: rear side) with respect to the protrusions 64A2, 64A5 in the Y-direction, that is, specifically, between the capacitor 70 side and the inner wall of the opening portion 36, and while holding the capacitor 70 onto the protrusion 64A2, 64A5 side (Y1 side: front side) by using the holding jig 80 with respect to the protrusions 64A2, the coating portion of the cream solder is heated. Thus, it becomes possible for the capacitor 70 to be attached to the chip-support-piece portion 63A without causing the positional-deviation. It should be noted that similarly as the above-mentioned first exemplified embodiment, it is allowed to mount the capacitor 70, for example, by a method of laser welding, etc.

<With Regard to Effect>

According to the antenna device 10A having such a constitution mentioned above, the terminal attachment unit 35 of the base 30 is arranged on one end side (X1 side) of the core 20 and this terminal attachment unit 35 is provided with the opening portion 36 of penetration-state. In addition, at least a pair of terminal members 60A (total three members in this exemplified embodiment) are attached to the terminal attachment unit 35. Then, the terminal member 60A is provided with a chip-support-piece portion 63A. This chip-support-piece portion 63A is positioned at the opening portion 36 and also, is electrically connected to a capacitor 70 while being equipped with the capacitor 70. Then, for the chip-support-piece portion 63A, there is provided a protrusion 64A which carries out the positioning of the capacitor 70.

Figure 9:
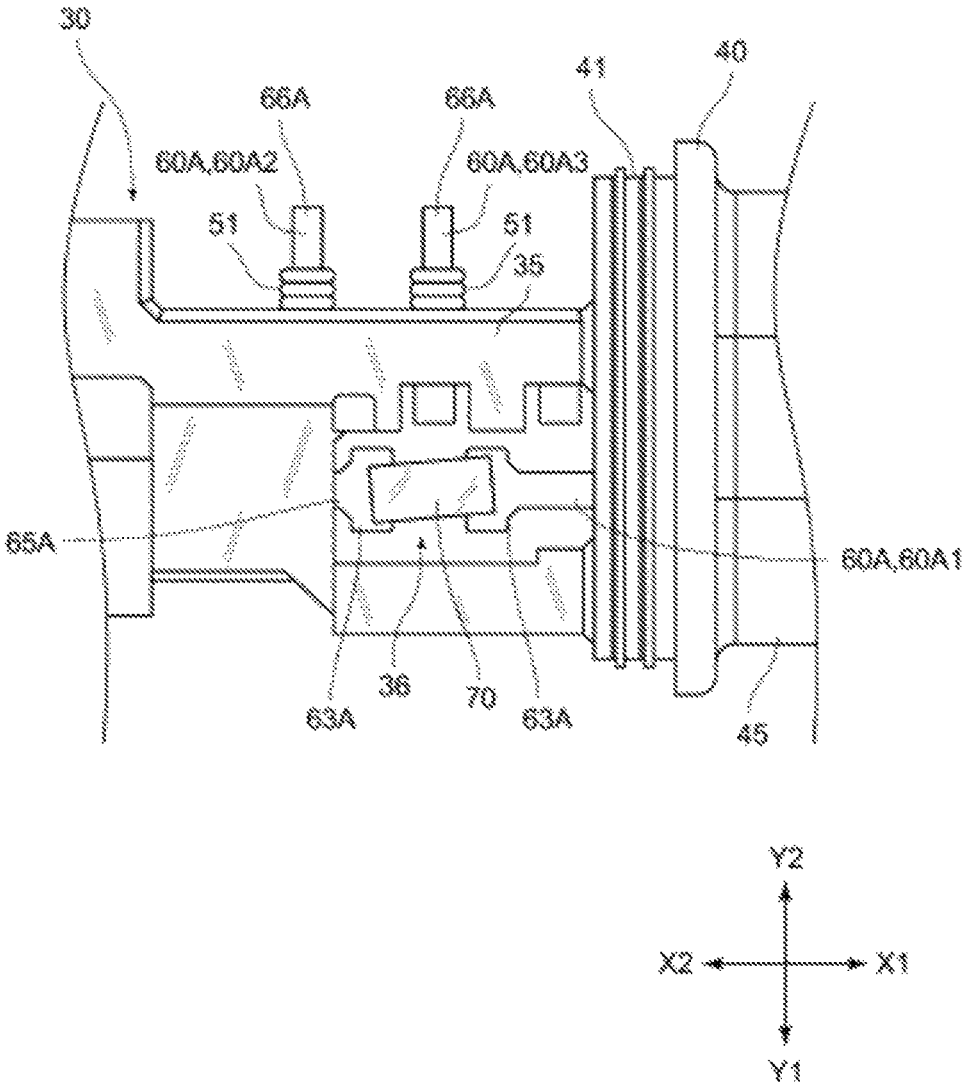
FIG. 9 relates to a comparative example and is a plan view showing a state in which the capacitor is inclined in case of using a constitution in which any protrusion does not exist for the chip-support-piece portion.

For this reason, when soldering the capacitor 70, it becomes possible to prevent the capacitor 70 from causing a positional-deviation. More specifically, in a case in which there exists no protrusion 64A, there is a fear, as shown in FIG. 9, that the capacitor 70 will float caused by a phenomenon in which the cream solder becomes in a liquid state on an occasion of the soldering and therefore, a positional-deviation will be caused for the capacitor 70. Such a positional-deviation will lead to a failure of soldering. It should be noted that FIG. 9 relates to a comparative example and is a plan view showing a state in which the capacitor 70 is inclined in case of using a constitution in which any protrusion 64A does not exist for the chip-support-piece portion 63A.

However, in this exemplified embodiment, owing to the fact that there is provided the protrusion 64A for the chip-support-piece portion 63A, it becomes possible to prevent the capacitor 70 from causing a positional-deviation even if the cream solder becomes in a liquid state. Therefore, it becomes possible to reduce failures of soldering.

In addition, in this exemplified embodiment, the positioner is formed as a protrusion 64A obtained by a portion of the chip-support-piece portion 63A, which is protruded compared with other portions thereof toward the equipped-side (Z1 side) of the capacitor 70. For this reason, even if a positional-deviation is going to be caused for the capacitor by a phenomenon in which the capacitor 70 floats in a liquid-state solder, it becomes possible to prevent the capacitor 70 from causing a positional-deviation excellently depending on the mechanism in which the capacitor 70 collides with the side surface of the protrusion 64A.

Second Exemplified Embodiment

Hereinafter, there will be explained an antenna device 10B relating to a second exemplified embodiment of the present invention with reference to the drawings. It should be noted in this exemplified embodiment that although there will be omitted the explanation with regard to the common constitutions with those of the antenna device 10A in the first exemplified embodiment mentioned above, it is assumed that Alphabet "B" will be put at the ends of the reference numerals thereof instead of Alphabet "A" relating to the corresponding elements in the first exemplified embodiment. It should be noted that the Alphabet "B" means a constitution relating to the second exemplified embodiment. Therefore, although there will be eliminated the explanations or the like in the second exemplified embodiment, it is assumed, also with regard to similar constitutions as those of the antenna device 10A in the first exemplified embodiment, that there is a case in which the explanation will be carried out by putting the Alphabet "B".

Figure 10:
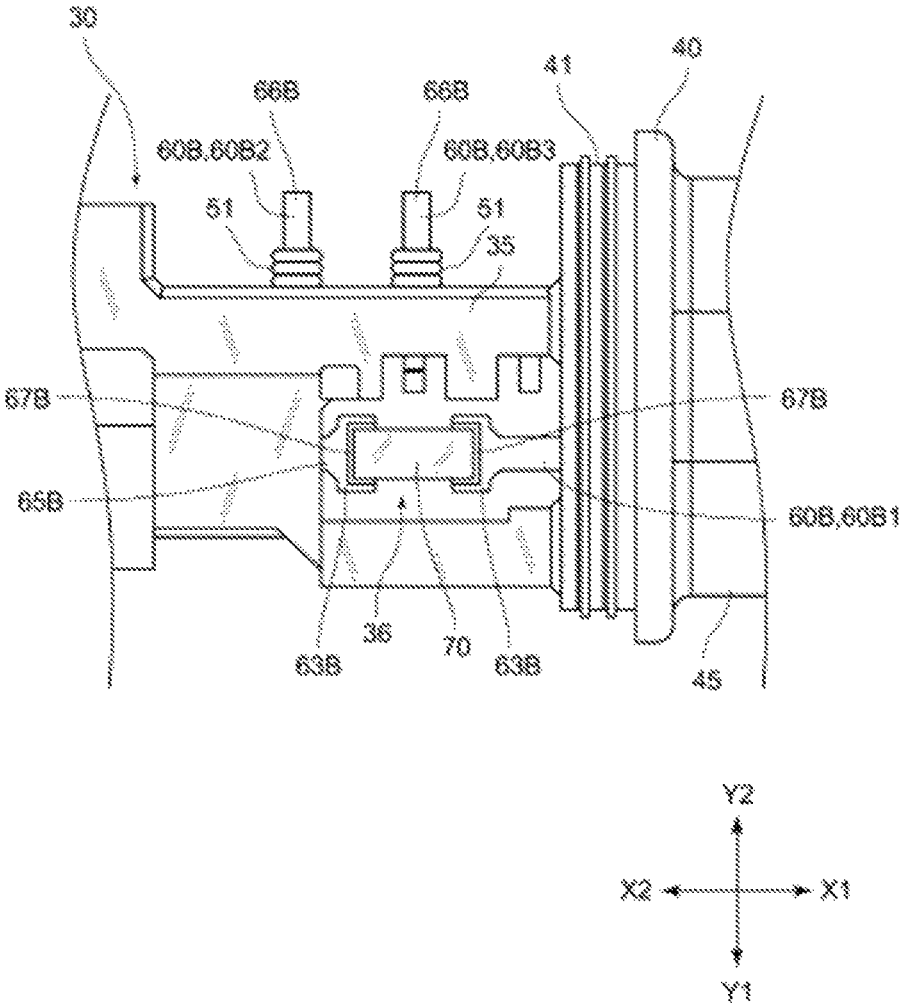
FIG. 10 is a view showing a constitution of an antenna device relating to a second exemplified embodiment of the present invention and is a plan view showing a vicinity of the terminal attachment unit by being enlarged.
Figure 11:
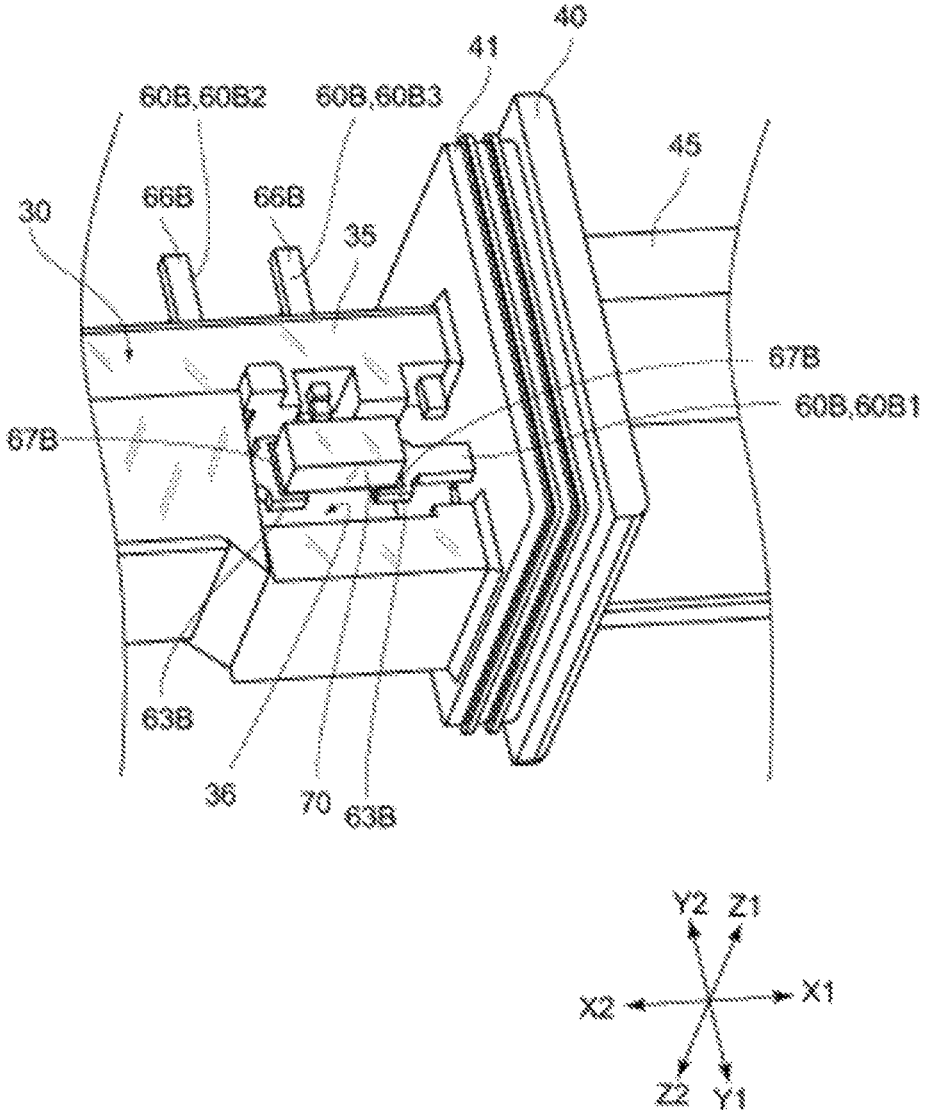
FIG. 11 is a perspective view showing the vicinity of the terminal attachment unit by being enlarged in the antenna device relating to the second exemplified embodiment.

In this exemplified embodiment, the constitution of the chip-support-piece portion 63B is different from that of the chip-support-piece portion 63A in the first exemplified embodiment. FIG. 10 is a plan view showing a vicinity of the terminal attachment unit 35 by being enlarged within the antenna device 10B relating to the second exemplified embodiment. FIG. 11 is a perspective view showing the vicinity of the terminal attachment unit 35 by being enlarged in the antenna device 10B relating to the second exemplified embodiment.

As shown in FIGS. 10 and 11, in this exemplified embodiment, the configuration of the chip-support-piece portion 63B is different. Specifically, there are provided positioning concave-portions 67B, which correspond to one example of the positioner for the chip-support-piece portion 63B, instead of the protrusions 64A such as those in the first exemplified embodiment. The positioning concave-portion 67B is a portion which is formed by recessing the chip-support-piece portion 63B in a step-difference shape and also in a planar shape.

Here, for each of the chip-support-piece portions 63B, the positioning concave-portion 67B is provided in a substantially rectangular-shape, in which there exist step-differences for the three sides within that substantially rectangular-shape but there exists no step-difference for the remaining one side, and in which the concave-portion 67B is provided in an opened state (a passing-through state). This opened portion is formed to be a position facing the positioning concave-portion 67B of the other chip-support-piece portion 63B. Therefore, it becomes possible to position the capacitor 70 excellently within the positioning concave-portions 67B which are portions lower by one step compared with the other portions of the chip-support-piece portions 63 and it becomes possible to prevent the positional-deviation of the capacitor 70 excellently.

It should be noted that for the modified examples of this exemplified embodiment, it is allowed to employ the following constitutions. Specifically, the positioning concave-portions 67B are provided in substantially rectangular-shapes in which there exist step-differences on the coupling portion 65B side and the terminal member 60B side within that substantially rectangular-shapes. Other than those above, there exists a step-difference on either side of the rear side (Y2 side) or the front side (Y1 side) of this rectangular-shape in which on the other side thereof, there exists no step-difference and this other side is provided in an opened state. When employing such a constitution, it is possible to positionally-fix the capacitor 70 by using the holding jig 80 shown in FIG. 8. It should be noted that it is also possible to employ a constitution in which there exist the step-differences only on the coupling portion 65B side and the terminal member 60B side within those substantially rectangular-shapes.

<With Regard to Manufacturing Method of Antenna Device 10B>

Also in case of manufacturing the antenna device 10B in this exemplified embodiment, it is possible to manufacture this antenna device similarly as the antenna device 10A in the first exemplified embodiment mentioned above. It should be noted that in case of forming the plate terminal 90 from a metal plate by press-processing or the like, it is preferable for the positioning concave-portions 67B to be formed concurrently. However, it is also allowed to employ a configuration in which the positioning concave-portions 67B will be formed by press-processing or the like after carrying out the punching process of the metal plate.

Then, the base 30 is formed by injection-molding and after forming the terminal members 60B1 to 60B3 by punching out the predetermined portions of the plate terminal 90 by using a press machine or the like, the capacitor 70 is mounted thereon. At that time, the cream solder is coated, for example, onto the positioning concave-portions 67B. The positioning concave-portion 67B is recessed compared with other portions of the chip-support-piece portion 63B and therefore, it becomes easy, for example, to carry out the positioning of the nozzle of the coating machine for coating the cream solder. In addition, owing to the configuration of coating the cream solder on the positioning concave-portion 67B, it becomes difficult for the coated cream solder to move to another portion.

It should be noted that the subsequent manufacturing processes are carried out similarly as those of the antenna device 10A in the first exemplified embodiment mentioned above. In addition, the positioning concave-portions 67B mentioned above are already formed beforehand when forming the plate terminal 90 by press-processing or the like of the metal plate. However, it is allowed to employ a configuration in which the positioning concave-portions 67B are formed concurrently when forming the terminal members 60B1 to 60B3 by punching out the predetermined portions of the plate terminal 90.

<With Regard to Effect>

In the antenna device 10B having a constitution as mentioned above, owing to the fact that there is provided the positioning concave-portion 67B for the chip-support-piece portion 63B, it becomes possible, similarly as the antenna device 10A in the first exemplified embodiment mentioned above, to prevent the capacitor 70 from causing a positional-deviation even if the cream solder becomes in a liquid state. Therefore, it becomes possible to reduce failures of soldering.

In addition, in this exemplified embodiment, the positioner is formed as a positioning concave-portion 67B which is obtained by recessing a portion of the chip-support-piece portion 63B toward the opposite side with respect to the mounting-side (Z1 side) of the capacitor 70. For this reason, it becomes possible to position the capacitor 70 within the positioning concave-portion 67B and it becomes possible to prevent the positional-deviation of the capacitor 70 excellently. In particular, the positioning concave-portion 67B is formed to have a concave shape and therefore, the positioning-property thereof is high. Therefore, it becomes possible to prevent the positional-deviation of the capacitor 70 more reliably.

Third Exemplified Embodiment

Subsequently, there will be explained an antenna device 10C relating to a third exemplified embodiment of the present invention with reference to the drawings. It should be noted in this exemplified embodiment that although there will be omitted the explanation with regard to the common constitutions with those of the antenna device 10A in the first exemplified embodiment mentioned above, it is assumed that Alphabet "C" will be put at the ends of the reference numerals thereof instead of Alphabet "A" relating to the corresponding elements in the first exemplified embodiment. It should be noted that the Alphabet "C" means a constitution relating to the third exemplified embodiment. Therefore, although there will be eliminated the explanations or the like in the third exemplified embodiment, it is assumed, also with regard to similar constitutions as those of the antenna device 10A in the first exemplified embodiment, that there is a case in which the explanation will be carried out by putting the Alphabet "C".

Figure 12:
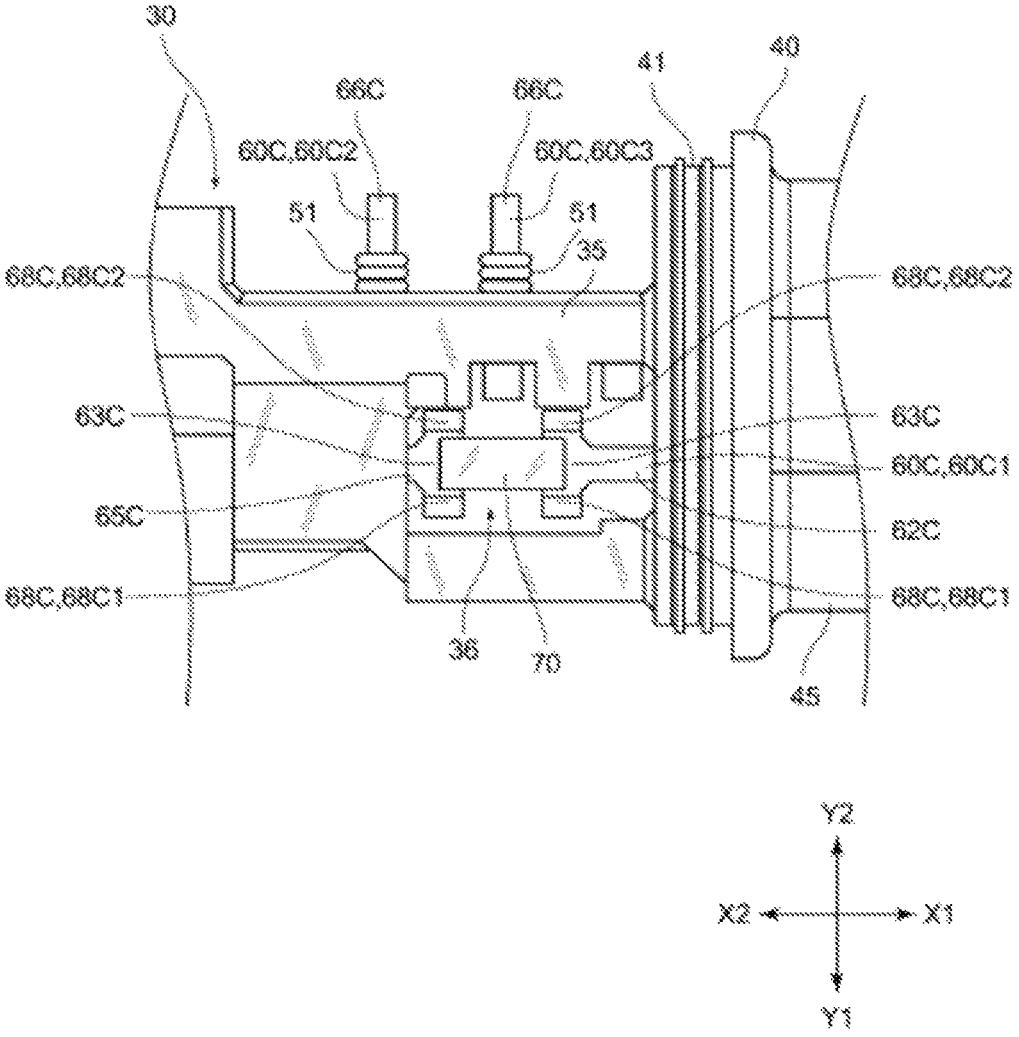
FIG. 12 is a plan view showing the vicinity of the terminal attachment unit by being enlarged in the antenna device relating to a third exemplified embodiment.
Figure 13:
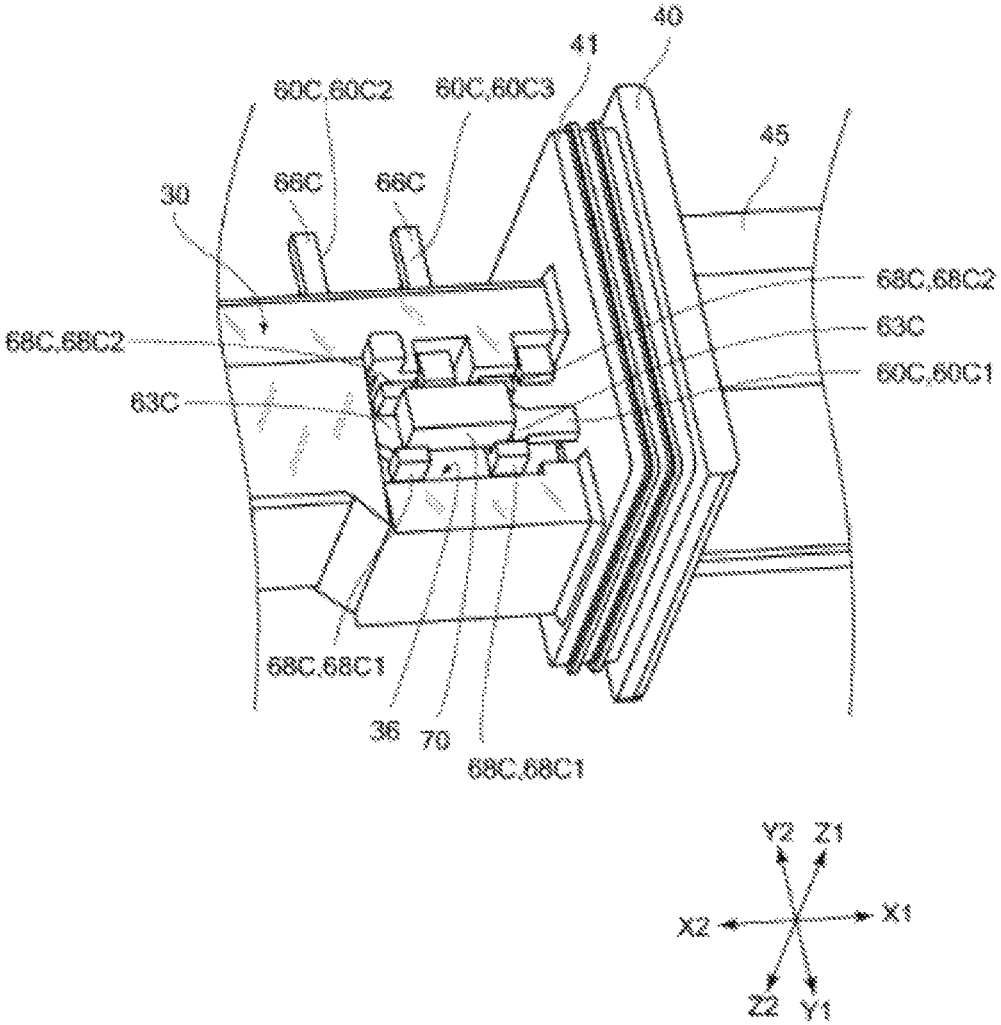
FIG. 13 is a perspective view showing the vicinity of the terminal attachment unit by being enlarged in the antenna device relating to the third exemplified embodiment.

Also in this exemplified embodiment, the constitution of the chip-support-piece portion 63C is different from that of the chip-support-piece portion 63A in the first exemplified embodiment. This configuration is shown in FIGS. 12 and 13. FIG. 12 is a plan view showing the vicinity of the terminal attachment unit 35 by being enlarged within the antenna device 10C relating to a third exemplified embodiment. FIG. 13 is a perspective view showing the vicinity of the terminal attachment unit 35 by being enlarged in the antenna device 10C relating to the third exemplified embodiment.

As shown in FIGS. 12 and 13, in this exemplified embodiment, there are provided bent portions 68C which correspond to one example of the positioner for the chip-support-piece portion 63C, instead of the protrusions 64A such as those in the first exemplified embodiment. The bent portion 68C is a portion which is formed by bending the vicinity of the edge portion of the width direction (Y-direction) of the chip-support-piece portion 63C so as to be directed toward the upper side (Z1 side).

For those bent portions 68C, there exists a bent portion which is provided on the front side (Y1 side) in the width direction (Y-direction), and likewise, there exists a bent portion which is provided on the rear side (Y2 side) in the width direction (Y-direction). Then, depending on these two bent portions 68C, the capacitor 70 is prevented from becoming in a state of positionally-deviated toward the width direction (Y-direction). Hereinafter, the bent portion 68C which exists on the front side (Y1 side) in the width direction (Y-direction) will be referred to as a bent portion 68C1 and the bent portion 68C which exists on the rear side (Y2 side) in the width direction (Y-direction) will be referred to as a bent portion 68C2.

In the constitution shown in FIGS. 12 and 13, it becomes a state in which the capacitor 70 is to be positioned by total four bent portions 68C, and there is obtained a state in which it becomes possible to prevent the capacitor 70 from causing a positional-deviation.

It should be noted that it is allowed to employ a configuration in which the bent portion 68C is to be provided by total two or three portions such as described in the modified example with respect to the first exemplified embodiment. In case of providing total two bent portions 68C, it is also possible to fix the capacitor 70 if a single bent portion 68C is provided on each of the both end sides which are positioned on a diagonal line centered on the capacitor 70. In addition, it is also conceivable to employ an example which has a constitution in which there are provided two bent portions 68C centered on the capacitor 70 at the positions on either one side of the rear side (Y2 side) thereof and the front side (Y1 side), and in which the other side (opposite side in the Y-direction) thereof is made to be opened without providing any bent portion 68C. In this case, it is possible to fix the capacitor 70 by using the holding jig 80 shown in FIG. 8. Further, there is no problem even if any single portion within the four bent portions 68C shown in this exemplified embodiment is to be removed. In other words, it is allowed to provide three bent portions 68C.

<With Regard to Manufacturing Method of Antenna Device 10C>

Also in case of manufacturing the antenna device 10C in this exemplified embodiment, it is possible to manufacture this antenna device similarly as the antenna device 10A in the first exemplified embodiment mentioned above. It should be noted that in case of forming the plate terminal 90 from the metal plate by a press-processing or the like, it is preferable for the bent portion 68C to be formed concurrently. However, it is also allowed to employ a configuration in which the bent portion 68C will be formed by press-processing or the like after carrying out the punching process of the metal plate.

Then, the base 30 is formed by injection-molding and after forming the terminal members 60C1 to 60C3 by punching out the predetermined portions of the plate terminal 90 by using a press machine or the like, the capacitor 70 is mounted thereon. At that time, the cream solder is coated on the portions surrounded by the bent portions 68C within the chip-support-piece portions 63C. Thereafter, the capacitor 70 is placed on the coating portions and thereafter, it is possible to attach mount the capacitor 70 onto the chip-support-piece portions 63C by heating or the like.

It should be noted that the subsequent manufacturing processes are carried out similarly as those of the antenna device 10A in the first exemplified embodiment mentioned above. In addition, it is allowed to employ a configuration in which the bent portions 68C are formed concurrently when forming the terminal members 60C1 to 60C3 by punching out the predetermined portions of the plate terminal 90.

<With Regard to Effect>

Also in the antenna device 10C having a constitution as mentioned above, owing to the fact that there is provided the bent portion 68C for the chip-support-piece portion 63C, it becomes possible, similarly as the antenna device 10A in the first exemplified embodiment or as the antenna device 10B in the second exemplified embodiment mentioned above, to prevent the capacitor 70 from causing a positional-deviation even if the cream solder becomes in a liquid state. Therefore, it becomes possible to reduce failures of soldering.

In addition, in this exemplified embodiment, the positioner is formed as a bent portion 68C which is obtained by bending the edge portion side of the chip-support-piece portion 63C so as to be directed toward the mounting-side (Z1 side) of the capacitor 70. For this reason, for the positioner, it becomes easy to enlarge the size which protrudes toward the upper side (Z1 side) and it becomes easy to realize a configuration in which it is easy to heighten the positioning property thereof. For that reason, it becomes possible to prevent the positional-deviation of the capacitor 70 more reliably.

Modified Example

As described above, one exemplified embodiment of the present invention was explained, but it is possible for the present invention to employ various kinds of modifications departing from that embodiment above. Hereinafter, there will be described this matter.

Figure 14:
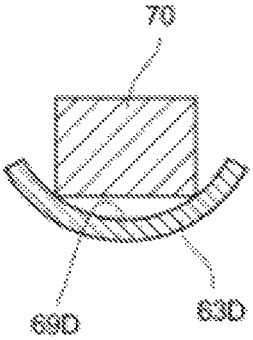
FIG. 14 is a view showing a constitution of a chip-support-piece portion relating to a modified example of the present invention and a view showing a state in which the chip-support-piece portion is cut along the width direction thereof.

In the above-mentioned first to third exemplified embodiments, the protrusion 64A, the positioning concave-portion 67B and the bent portion 68C were explained as the positioners. However, the positioner is not to be limited by these elements and it is needless to say that it is possible to employ an element having another constitution. An example of the element having another constitution is shown in FIG. 14. FIG. 14 is a view showing a constitution of a chip-support-piece portion 63D relating to a modified example of the present invention and a view showing a state in which the chip-support-piece portion 63D is cut along the width direction (Y-direction) thereof.

As shown in FIG. 14, the cross-sectional shape in the width direction (Y-direction) of the chip-support-piece portion 63D is formed to have a curved shape. More specifically, the chip-support-piece portion 63D has a curved surface 69D. For this reason, it is possible to carry out the positioning of the capacitor 70 by a mechanism in which the end portion of the aforesaid capacitor 70 in the width direction (Y-direction) thereof is in contact with the curved surface 69D of the chip-support-piece portion 63D. More specifically, the curved surface 69D of the chip-support-piece portion 63D functions as a positioner. In particular, according to this exemplified embodiment, the capacitor 70 is in contact with respect to the curved surface 69D at the end portion thereof by a line shape and therefore, even if the solder melts in a liquid state, it is possible to obtain a state in which it is difficult for the capacitor 70 to float up. Therefore, it is possible to heighten the positioning property of the capacitor 70 further more.

Figure 15:
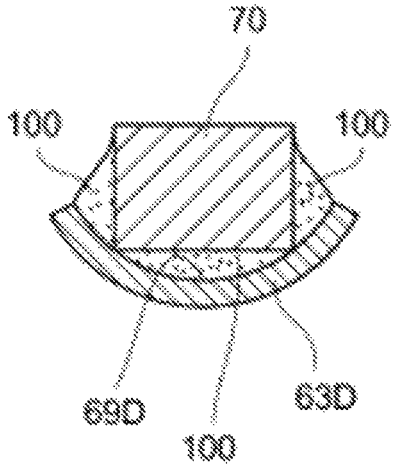
FIG. 15 is a view showing a constitution of the chip-support-piece portion when soldering is carried out at the chip-support-piece portion shown in FIG. 14 and is a view showing a state in which the chip-support-piece portion is cut along the width direction thereof.

FIG. 15 is a view showing a constitution of the chip-support-piece portion 63D when soldering is carried out at the chip-support-piece portion 63D shown in FIG. 14 and is a view showing a state in which the chip-support-piece portion 63D is cut along the width direction (Y-direction) thereof. As shown in FIG. 15, in case of forming a soldering portion 100 by soldering the capacitor 70 onto the chip-support-piece portion 63D, there will exist, between the capacitor 70 and the curved surface 69D, a portion whose thickness becomes thick. Therefore, owing to a configuration that at the soldering portion 100, there is formed a portion whose thickness is thick, it becomes possible to prevent the solder crack from occurring. It should be noted that owing to the fact that the curved surface 69D exists, it is possible for the soldering portion 100 in the configuration shown in FIG. 15 to form total three portions in the width direction (Y-direction), each of which has a thick thicknesses. Therefore, it becomes possible to heighten the reliability of the soldering further more.

Figure 16:
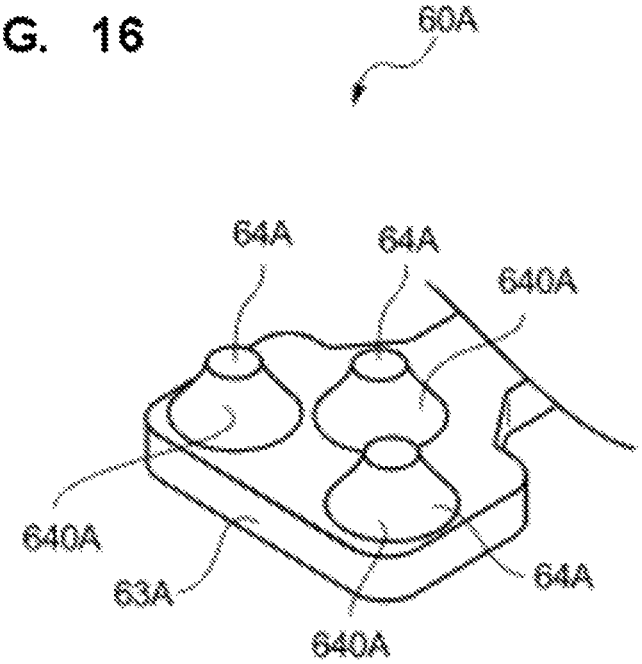
FIG. 16 is a perspective view showing a constitution of the chip-support-piece portion relating to a modified example of the first exemplified embodiment.

In addition, in the above-mentioned first exemplified embodiment, it is allowed to employ such a constitution as shown in FIG. 16. FIG. 16 is a perspective view showing a constitution of the chip-support-piece portion 63A relating to a modified example of the first exemplified embodiment. As shown in FIG. 16, the protrusion 64A includes a skirt portion 640A whose cross-sectional area, which is obtained when being cut by the surface parallel to the XY plain, becomes larger along with going toward the lower side (Z2 side). The skirt portion 640A is provided to have a curved-surface shape and therefore, similarly as in the case shown in FIG. 15, the capacitor 70 will be in contact with the protrusions 64A at the end portions thereof. For this reason, even if the solder melts in a liquid state, it is possible to obtain a state in which it is difficult for the capacitor 70 to float up. In addition, it is possible to form portions having thick thicknesses at the soldered portions (corresponding to the soldering portions 100 in FIG. 15) between the capacitor 70 and the chip-support-piece portion 63A or the protrusions 64A, and therefore, it becomes possible to prevent the solder crack from occurring. Therefore, it becomes possible to heighten the reliability of the soldering further more.

In addition, in the respective exemplified embodiments mentioned above, the protrusion 64A, the positioning concave-portion 67B and the bent portion 68C were explained as the positioners, and further, the curved surface 69D was explained as the positioner in FIGS. 14 and 15 and the protrusion 64A including the skirt portion 640A was explained as the positioner in FIG. 16. However, it is allowed for the positioner to employ a configuration obtained by combining at least two shapes within those above. More specifically, it is allowed to employ a configuration in which the positional-deviation of the capacitor 70 is prevented by arbitrarily combining positioners having convex and concave shapes.

In addition, in the above-mentioned exemplified embodiment, the capacitor 70 was explained for the electronic component. However, the electronic component is not limited by the capacitor 70. It is possible to use various kinds of electronic components such as, for example, a chip resistor, a chip diode and the like. In addition, the electronic component is not limited by a case in which only one electronic component is used, and it is allowed to use a plurality of same or different electronic components.

In addition, in the above-mentioned exemplified embodiment, the electronic component is assumed to be of a surface-mount type. However, the electronic component is not limited by the surface-mount type and it is allowed to employ another type such as, for example, a pin type.

In addition, in the above-mentioned exemplified embodiment, only one core is used within the core 20, but it is allowed to use a plurality of cores.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. An antenna device comprising:

a core formed by a magnetic material;

a terminal attachment unit which is arranged on one end side of the core;

a coil arranged on the outer-peripheral side of the core by winding a conductive wire; and at least a pair of terminals which are attached to the terminal attachment unit, wherein a penetrating opening is defined in and penetrates through the terminal attachment unit, two supporting portions with top surfaces and bottom surfaces of the terminals are extended into the opening portion separately, an electronic component is attached on the top surfaces of the supporting portions, at least a positioner is formed on each of the supporting portions of the terminals, and the electronic component is fixed on the supporting portions by the positioners.

2. The antenna device according to claim 1, wherein the positioners are formed by protruding parts of the supporting portions upward from the bottom surfaces to the top surfaces.

3. The antenna device according to claim 1, wherein the positioners are formed by recessing parts of the supporting portions downward from the top surface to the bottom surface.

4. The antenna device according to claim 1, wherein the positioners are formed by bending the edges of the supporting portions upward from the bottom surfaces to the top surfaces.

5. The antenna device according to claim 1, wherein the cross section shape of the supporting portions is formed into a curved shape, and the edges of the supporting portions are used as positioners.

* * * * *